US006234302B1

(12) United States Patent
Greiner et al.

(10) Patent No.: US 6,234,302 B1
(45) Date of Patent: May 22, 2001

(54) TRANSFER SYSTEM HAVING A FAILURE PROTECTION DEVICE

(75) Inventors: Martin Greiner, Heiningen; Walter Rieger, Goeppingen; Karl Thudium, Waeschenbeuren, all of (DE)

(73) Assignee: Schuler Pressen GmbH & Co. KG, Goeppingen (DE)

( * ) Notice: Subject to any disclaimer, the term of this patent is extended or adjusted under 35 U.S.C. 154(b) by 0 days.

(21) Appl. No.: 09/394,897

(22) Filed: Sep. 13, 1999

(30) Foreign Application Priority Data

Sep. 11, 1998 (DE) ..... 198 41 621

(51) Int. Cl.[7] ..... B65G 25/00

(52) U.S. Cl. ..... 198/621.1; 72/405.13; 72/405.16

(58) Field of Search ..... 198/621.1; 72/405.11, 72/405.12, 405.13, 405.16; 414/226.01, 751.1; 100/207, 215

(56) References Cited

U.S. PATENT DOCUMENTS

| | | | | |
|---|---|---|---|---|
| 4,540,087 | | 9/1985 | Mizumoto . | |
| 5,779,025 | * | 7/1998 | Dangelmayr et al. | 198/621.1 |
| 5,934,125 | * | 8/1999 | Takayama | 72/405.13 |
| 6,073,551 | * | 6/2000 | Dangelmayr et al. | 100/207 |

* cited by examiner

*Primary Examiner*—Joseph E. Valenza
(74) *Attorney, Agent, or Firm*—Evenson, McKeown, Edwards & Lenahan, P.L.L.C.

(57) ABSTRACT

A transfer system has at least one transfer device which is driven by several mutually independent drives in the direction of at least a closing/opening axis. In the event of a failure of a drive, an immediate stoppage of parts of the transfer device is prevented by coupling the drives with one another by a coupling device. This coupling device has an operating range of a low torque transmission which is normally taken up and is left only if one of the drives no longer supplies a sufficient driving power.

20 Claims, 8 Drawing Sheets

TRANSFER SYSTEM HAVING A FAILURE PROTECTION DEVICE

BACKGROUND OF THE INVENTION

This application claims the priority of 198 41 621.0, filed Sep. 11, 1998, the disclosure of which is expressly incorporated by reference herein.

The present invention relates to a transfer system having a failure protection system.

Typical known transfer systems are, for example, three-axis transfer systems, feeding or removing devices. For example, DE 33 29 900 C2 discloses a three-axis transfer system having two parallel transfer rails spaced from one another. These are arranged along the parts-transporting direction such that, between one another, they enclose the individual working stations defined by press tools. The transfer bars carry out a transfer movement which contains a lifting and lowering component as well as a transporting component directed in the longitudinal direction of the transfer bars. In addition, for receiving workpieces and for depositing workpieces, the transfer bars are moved laterally toward and away from one another. Electric drives are used for moving the transfer bars.

For receiving workpieces, the transfer bars are laterally adjusted such that corresponding gripper and receiving devices engage with and receive the workpieces. For this purpose the transfer bars must be moved laterally into the open tool. After the depositing of the workpieces in the respective next following open tool, the transfer bars must be moved laterally out of the tool, before this tool closes again.

For the lateral opening or closing movement of the transfer bars, a narrowly defined time window must be observed. If the bars are late during the opening, a collision may occur between the closing tool and the transfer bars or their gripper or receiving devices. This results in extensive damage.

SUMMARY OF THE INVENTION

An object of the present invention is to provide a transfer system which moves its transfer devices with an increased safety within defined time windows.

This object has been achieved by providing a transfer system having a transfer device, which is linked with at least one working station, having at least two driving devices which are both assigned to the transfer device, and having a coupling device, by means of which the driving devices are connected with one another and which, in a selected relative movement or operating range, has a power or torque transmission which is lower in its amount than a limit value, and which otherwise has a higher power or torque transmission.

The transfer system according to the present invention has a mechanical transfer device which supplies workpieces to at least one working station and removes workpieces from this working stations and in linked to this working station in this sense. The transfer device is driven by several, at least two driving device which are coordinated with one another and preferably operate synchronously. The driving devices are connected by a coupling device which has a selected working range in which the work transmission or torque transmission is low or zero. This working range is a passive range in which a mutual influencing of the drives is low or impossible. When there is a departure from this working range, the coupling device transmits so much force or torque between the driving devices that the movement of the transfer device is carried out in the defined time window, and a collision between the transfer devices and devices of the work station is avoided.

The coupling device permits independent operation of the driving devices so that there can be no disturbances or interferences between the two driving devices if these are operated properly. If one driving device does not operate properly, however, there will be a departure or leaving from the passive range of the coupling device. As a result, the remaining, properly operating driving device is permitted to carry out the function of the driving device which is no longer operating properly. If, for example, one driving device fails, the concerned drive will no longer be stopped but is pulled along by way of the coupling device by the properly operating driving device, at least first until moving out of the collision range.

In a transfer press, the transfer devices are preferably formed by two transfer bars which are arranged parallel to one another and extend along a transporting direction. The transfer bars preferably span several working stations and cause the workpiece transport from one station to the next. For receiving workpieces, the transfer bars are moved toward one another and for the release, carry out a movement away from one another. These movements are caused by the two driving devices. One driving device is assigned to one transfer bar and the other driving device is assigned to the other transfer bar. The coupling device passively couples these two driving devices with one another. That is, in normal operation, no power transmission takes place by way of the coupling device. Additional driving device pairs of this type may be arranged along the longitudinal direction of the transfer bars. Each pair of driving devices contains two driving devices respectively which are coupled with one another. As required, however, other driving devices may also be coupled with one another by corresponding coupling devices. The advantage of the coupling of transfer systems which are arranged side-by-side and which are each assigned to different transfer bars is the close spatial proximity so that only a short spatial distance must be bridged by the coupling device and corresponding transmission devices.

The coupling device is preferably a mechanical coupling device, such as a rotating coupling device or a translational coupling device. The coupling device has an operating range with a low torque transmission or power transmission. This may be a play range which, in a rotating coupling, is a rotating play. In a translational coupling, the play range is a translational play. In this play range, the power transmission or torque transmission may be low. In any case, it falls below a limit value which is such that the properly operating drives are virtually unconnected with one another. This permits arrangement of the driving devices in mutually independently operating control loops which each separately set a uniformly defined desired value which can change with respect to time. Control oscillations or control deviations also of a temporary nature do not lead to a disturbance between the driving devices. This is particularly true when the selected working or play range is at least as large as the sum of the amounts of the temporary control deviations to be maximally expected in the case of both drives.

Outside this operating range, a considerable torque transmission takes place which is at least so large that, in the range of the failed or no longer fully operable drive, the transfer device is moved properly, i.e., within a time-related tolerance field, out of a danger zone defined by the working station.

In the ideal case, the characteristic curve of the coupling device is therefore a bent characteristic curve which has no torque transmission or power transmission for rotating angle or path differences between the two drives which fall below a limit value. In this situation, the characteristic curve is axially in parallel to an angle axis or path axis in a torque (power)-angle (path) diagram. Outside this operating range, an increase of the angle difference or path difference is ideally no longer permitted. In this case, the characteristic curve is in parallel to the torque (power) axis in the above-mentioned diagram. As an alternative, the coupling device may have a certain flexibility in order to configure the coupling engagement not to be excessively hard.

Instead of the rotating angle difference or path difference, a differential rotational speed or a differential moving speed can also be used as a criterion for engagement and disengagement of the coupling device. Furthermore, spring or damping devices can be arranged on the coupling device. In addition to moving the transfer rails and the gripper devices out of the tool range, the present invention also permits a temporary manufacturing operation with a then, if required, reduced number of strokes (working speed).

In the foregoing embodiments, the coupling device is self-controlled. It may, however, also be externally controlled and be coupled in, for example by an (electric) error signal which is emitted by one of the drives.

As required, the coupling device may be such that the existing operating range with a low torque transmission is limited to a smaller value or to zero, once there has been a falling-below this value. For the operation with a possibly reduced number of strokes, such a coupling device may contain an additional coupling tool, which engages in a frictional or form-locking manner. In addition, filler pieces can be inserted in the coupling device which reduce the play to a certain extent or to zero. The coupling device can be connected with sensor devices which signal whether and when the selected defined operating range has been exceeded. These signals may be used as an error criterion for a superimposed control.

The inventive concept can be used for opening and closing of transfer bars by way of independent electric drives. It can also be used for drives which cause the lifting and lowering or the driving in the transporting direction. In addition, a corresponding coupling device may be used in the case of non-electric drives. Drives of different transfer bars, as well as of one and the same transfer bar, can be coupled with one another in this manner. The invention also can be used for driving devices in the case of which two driving or adjusting devices act directly, optionally also indirectly, for example, by way of transmission devices, onto a shaft or another power transmission device.

BRIEF DESCRIPTION OF THE DRAWINGS

Other objects, advantages and novel features of the present invention will become apparent from the following detailed description of the invention when considered in conjunction with the accompanying drawings.

DETAILED DESCRIPTION OF THE DRAWINGS

Figure 1:
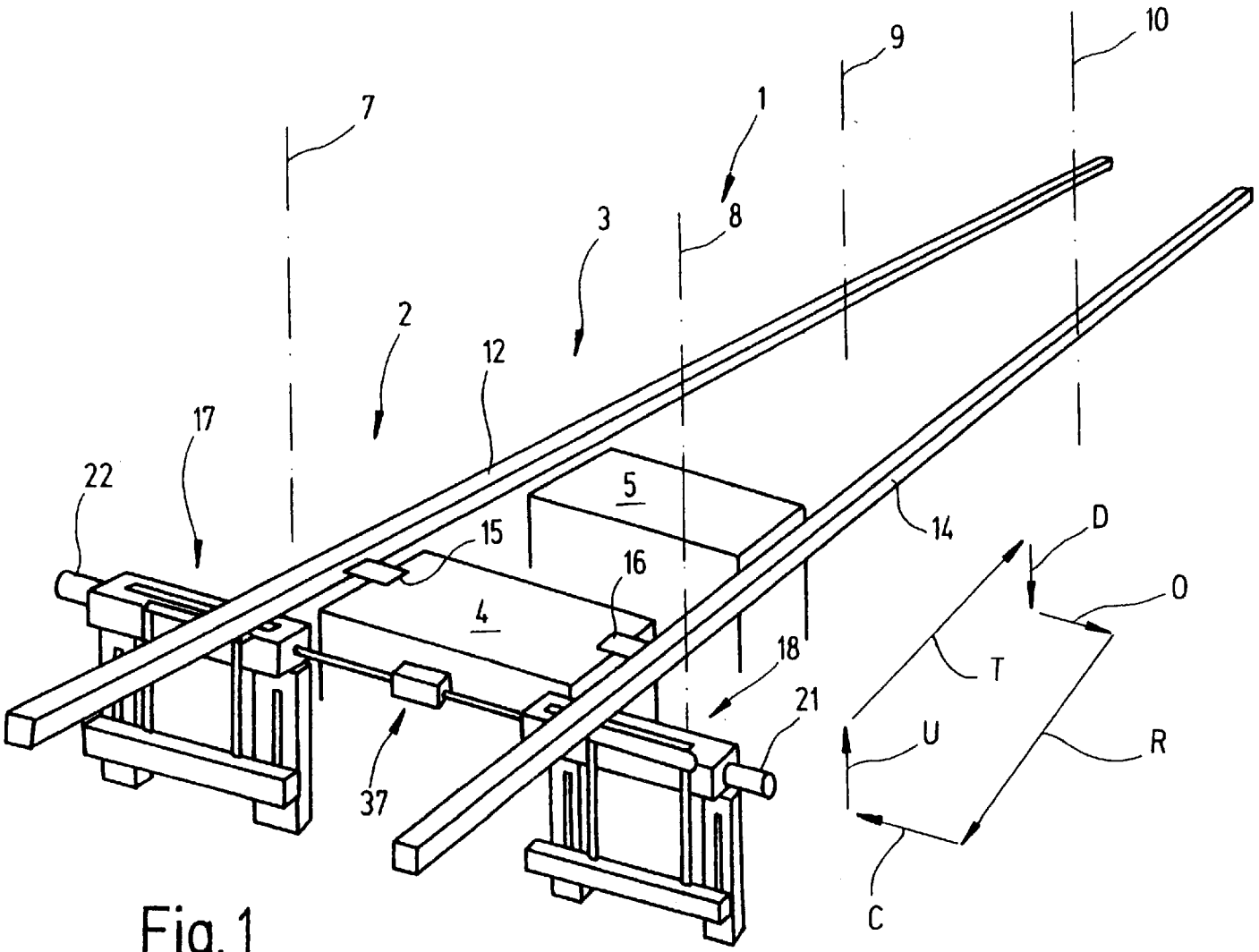
FIG. 1 is a perspective, schematic partial view of a transfer system of a press working line.

FIG. 1 illustrates a transfer system 1 which extends along several press stations 2, 3 which are outlined by their bedplates 4, 5. The working stations 2, 3 are press stations of a multistation press which is indicated in FIG. 1 only by way of its press stands represented by dash-dotted lines 7, 8, 9, 10.

The transfer system includes two spaced transfer bars 12, 14 which are parallel to one another and which are provided with receiving blades 15, 16 or with other receiving devices which are equipped for receiving workpieces, such as relatively large sheet metal parts, and transporting them to the respective next tool. For this purpose, the transfer bars 12, 14 carry out a three-axis transfer movement. This movement is illustrated in FIG. 1 by arrows U, T, D, O, R and C. The transfer bars 12, 14 are cyclically or periodically lifted (U) and moved into the transporting direction T, moved downward (D), moved away from one another, i.e., opened (O) and moved back (R) against the transporting direction T, and are again moved toward one another, i.e., closed (C). The sequence of movements can be as described in DE 44184417 A1.

Figure 2:
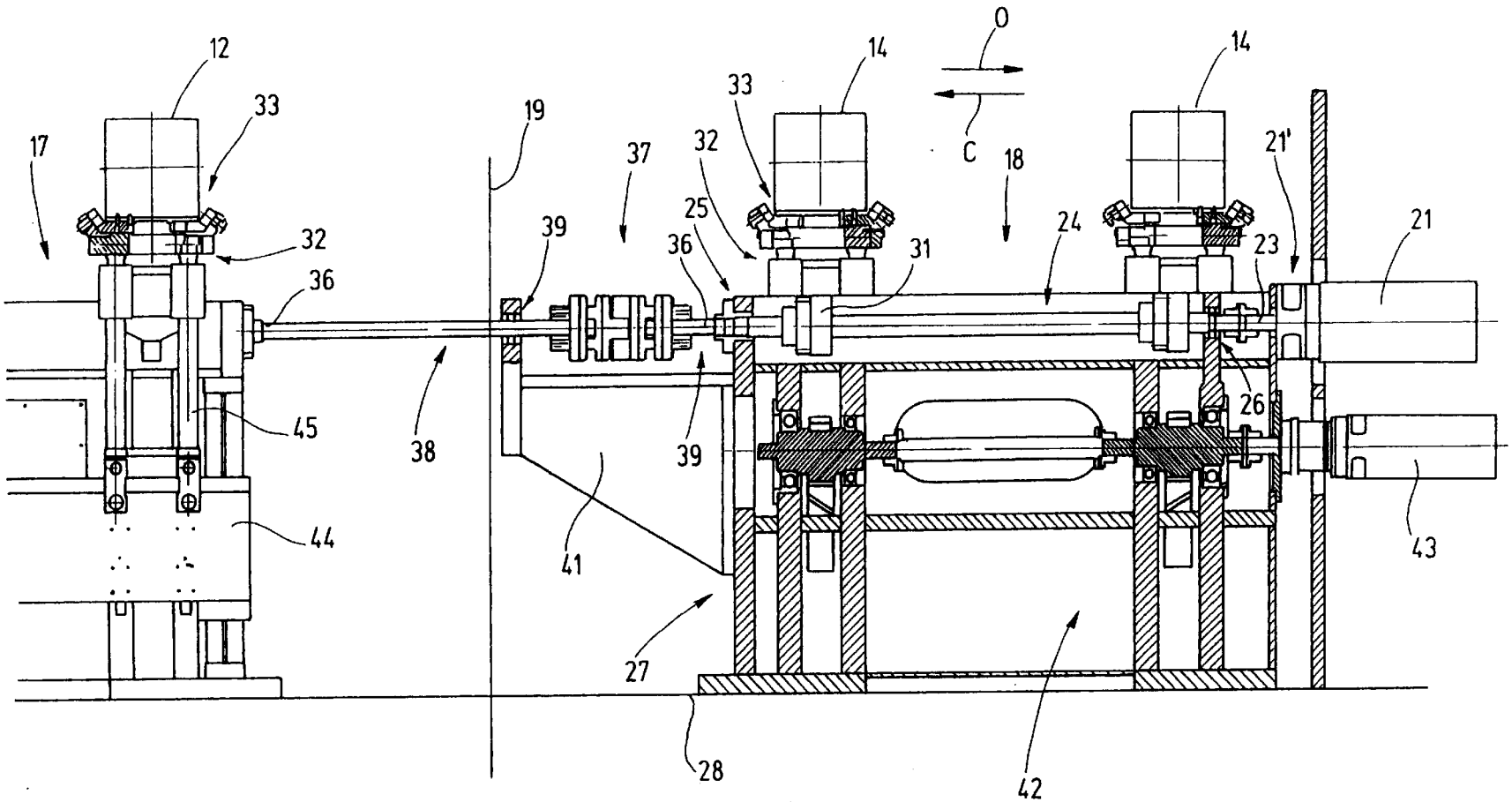
FIG. 2 is a simplified cross-sectional, partial view of the transfer system according to the present invention.

For the opening and closing, that is, for moving the transfer bars 12, 14 toward one another and away from one another, closing boxes 17, 18 are provided which cause the lateral movement of the transfer bars 12, 14 in the direction of the arrows C and O. The closing boxes 17, 18 are illustrated in detail in FIG. 2 and arranged symmetrically to a vertical longitudinal center line 19. The closing box 18, which is on the right in FIG. 2, is provided with an electric motor 21. Likewise, the closing box 17 is provided with an electric motor 22 which, however, is outlined only in FIG. 1. Both electric motors 21, 22 are automatically position-controlled servomotors with a flanged-on transmission 21', 22'. Their respective main drive pinion 23 is rigidly coupled with a threaded spindle 24 which, by way of ball bearings 25, 26, is disposed in a base 27 which is stationarily set up on a floor 28 (foundation) or on tables.

A nut 31, which preferably has a recirculating ball system and, together with the threaded spindle 24, forms a linear drive for the lateral movement C, O of the transfer bar 12, 14, is disposed on the threaded spindle 24. In FIG. 2, this is illustrated by the double representation of the transfer bar 14. On the left in FIG. 2, the transfer bar 14 is in its extreme closing position in which it is positioned as closely as possible to the longitudinal center plane 19; and on the right, it is shown in its widest opening position in which it is away as far as possible from the longitudinal center plane 19. As the result of the forward and backward rotation of the electric motor 21 and a corresponding rotation of the threaded spindle 24, the transfer bar 14 can be moved between the two positions.

The transfer bar 14 is longitudinally displaceably disposed on a support 32. Guide rollers 33, flat guides or form guides are used for this purpose which transmit each lateral movement (arrow C or O) to the transfer bar. The transfer bar, however, is movable in the longitudinal direction independently thereof.

The two closing boxes 17, 18 are constructed mirror-symmetrically with respect to one another. The respective threaded spindle 24 in each case project by way of one end 36 out of the closing box. The two ends 36 are connected with one another by way of a coupling device 37 and torque-transmitting shafts 38, 39. The shafts 38, 39 may be constructed to be torsion-proof as well as with a certain torsional flexibility. Independently thereof, the coupling device 37 can be arranged in the center or asymmetrically, in which case the shaft 38 is additionally disposed, for example, by way of a ball bearing 39, which is supported by way of a support 41 on the base 27 of the closing box 18.

In addition, another drive 41 is provided which includes one electric motor 43 respectively and which causes the lifting and lowering of the transfer bars 12, 14. The drive 42 causes a corresponding carriage 44, which is disposed to be vertically displaceable on two guides, to be moved vertical upward and downward. The carriage movement is transmitted by corresponding pressure rods 45 to the intermediate support 32 which is driven by the closing box in the lateral direction.

Figure 3:
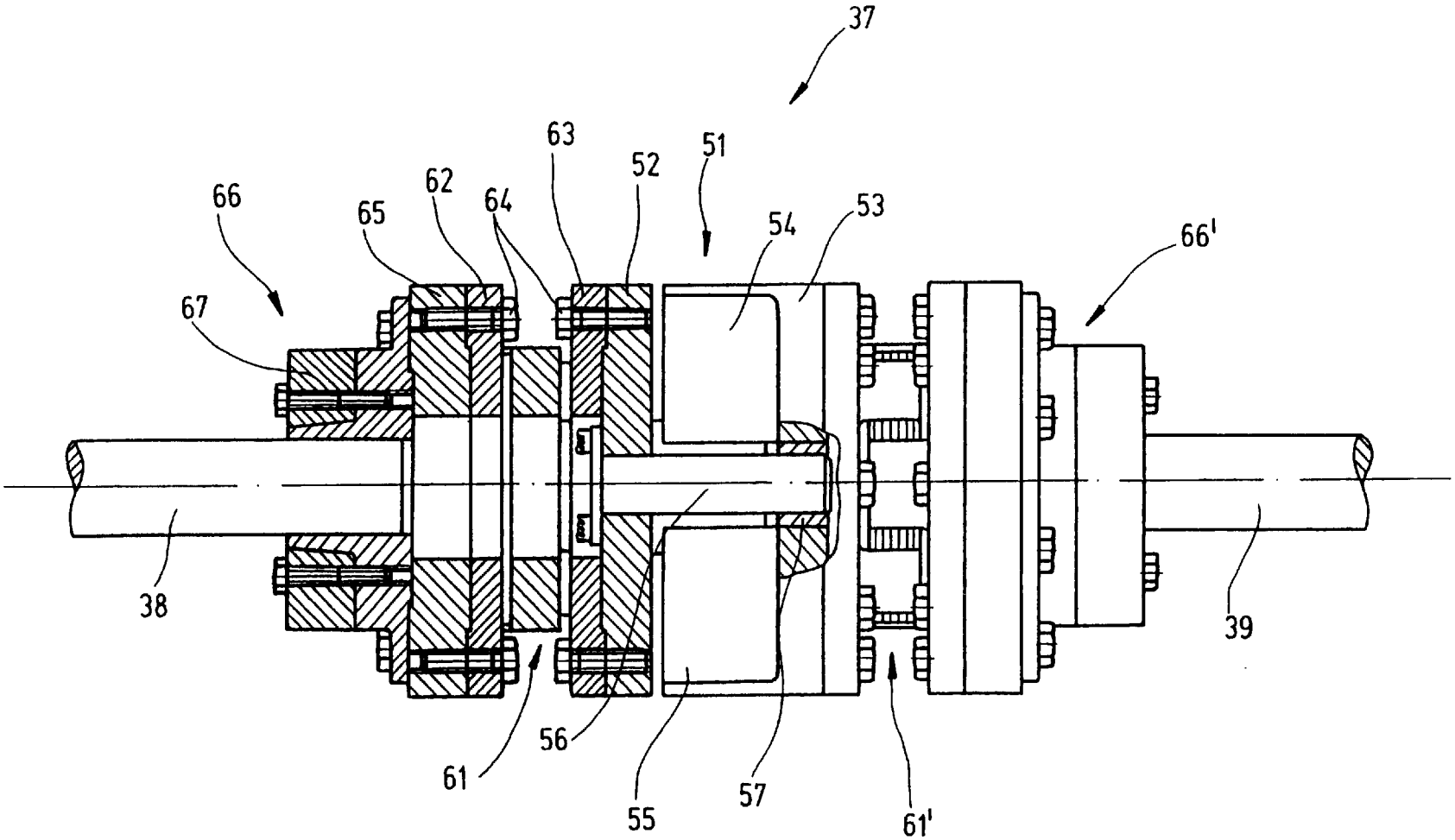
FIG. 3 is a schematic, partially cross-sectional view of a coupling device of the transfer system shown in FIG. 2.

The coupling device 37 arranged between the closing boxes 17, 18 is separately illustrated in FIG. 3. The core of the coupling device 37 is a claw coupling 51, whose coupling halves 52, 53 carry, for example, axial extensions 54,55 which engage with one another with an angle play of between 45 and 175 degrees. The drives of the two closing boxes 17, 18 are adjusted such that the wings or claws 54, 55 of the coupling halves 52, 53 are each situated in the center in the gap between the claws of the respective other coupling half without contacting these. For the centering, an axial pin 56 is constructed on the coupling half 52 and engages in an axial bush of the coupling half 53. This ensures a coaxial alignment of both coupling halves 52, 53 also when the coupling halves transmit no torque, that is, are adjusted in the play range.

The coupling half 52 is screwed to a damper element 61. This damper element 61 has end plates 62, 63 which are connected by screws or bolts 64 on the coupling half 52 or on a steel disk 65. This steel disk 66 is non-rotatably connected with the shaft 38 by a clamp coupling 66 in a force-locking or form-locking manner.

Similarly, the coupling half 53 is connected with the shaft 39 by a rotary damper 61' and a corresponding clamp coupling 66'.

Figure 4:
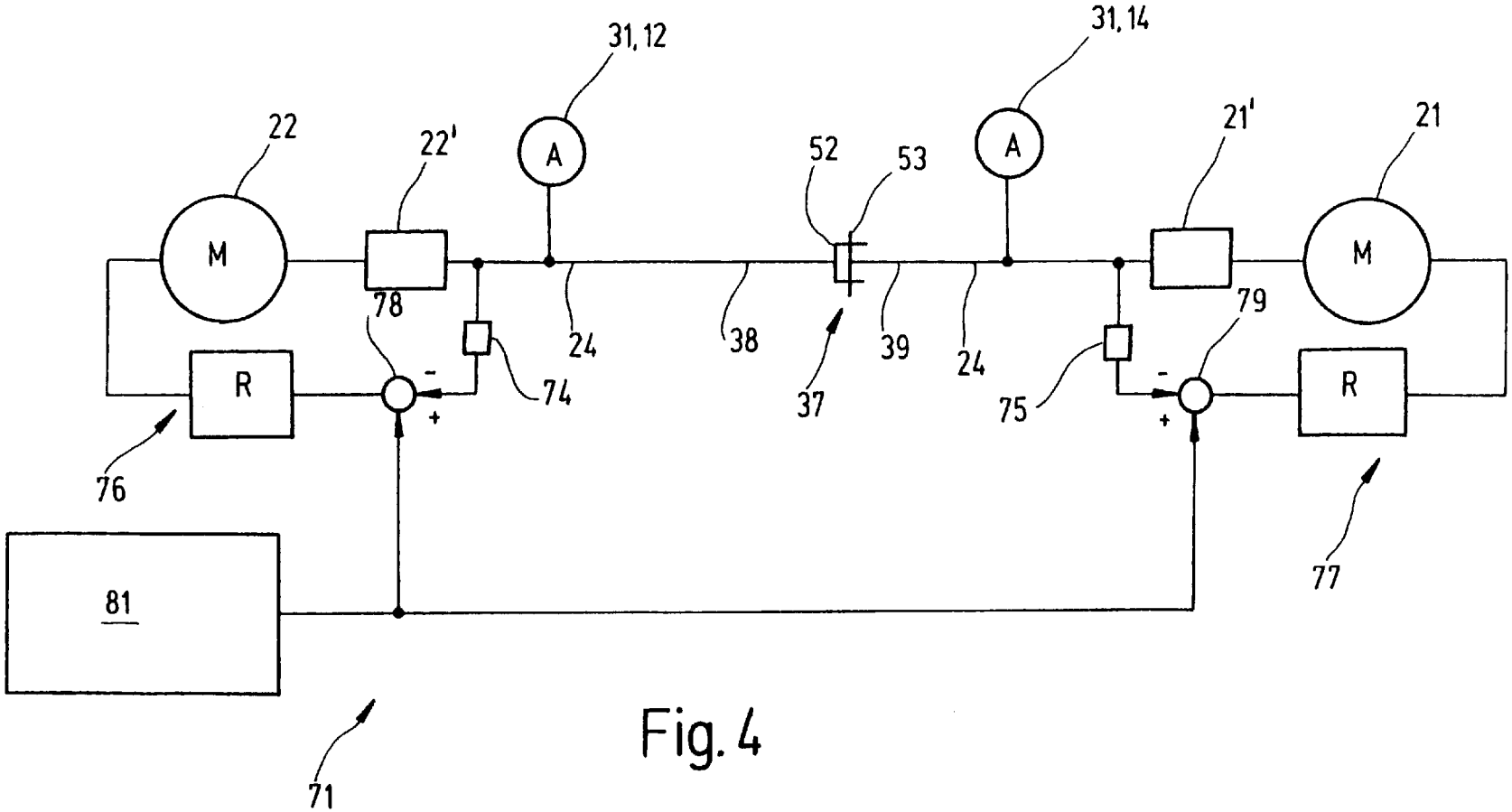
FIG. 4 is a schematic diagram of the driving devices and their automatic control and control devices of the transfer system shown in FIGS. 1 to 3.

The electric motors 21, 22 are automatically controlled by the system 71 illustrated in FIG. 4. By way of its transmission 21', 22', each motor 21, 22 acts upon the respective threaded spindle 24. On each threaded spindle 24, the respective nut 31 is disposed which is symbolically illustrated in FIG. 4 as the main drive pinion A. The threaded spindles 24 are connected with one another by the coupling device 37 which has a considerable rotational play. Position sensors 74, 75 are arranged on the threaded spindles 24 or at another suitable point, to emit a signal which corresponds to the position of the respective transfer bar 12, 14 in the respective adjusting direction (in the present embodiment, in the direction C or O). These signals are supplied to an automatic control loop 76, 77. For this purpose, each automatic control loop 76, 77 has an adder 78, 79, which compares the position signal (actual signal) emitted by the sensor 74, 75 with a desired signal. This desired signal is defined equally by a control system 81 of the two automatic control loops 76, 77. In this case, the signals are converted such that a default signal of the control system 81 in each case determines the distance of the main drive pinion 31 from the longitudinal center plane 19.

Both automatic control loops 76, 77 operate independently of one another, and both separately from one another provide a condition in which the actual signal comes as close as possible to the desired signal. For this purpose, the corresponding controllers R are used, which may be constructed as P controllers, as PI controllers or as PID controllers.

Figure 5:
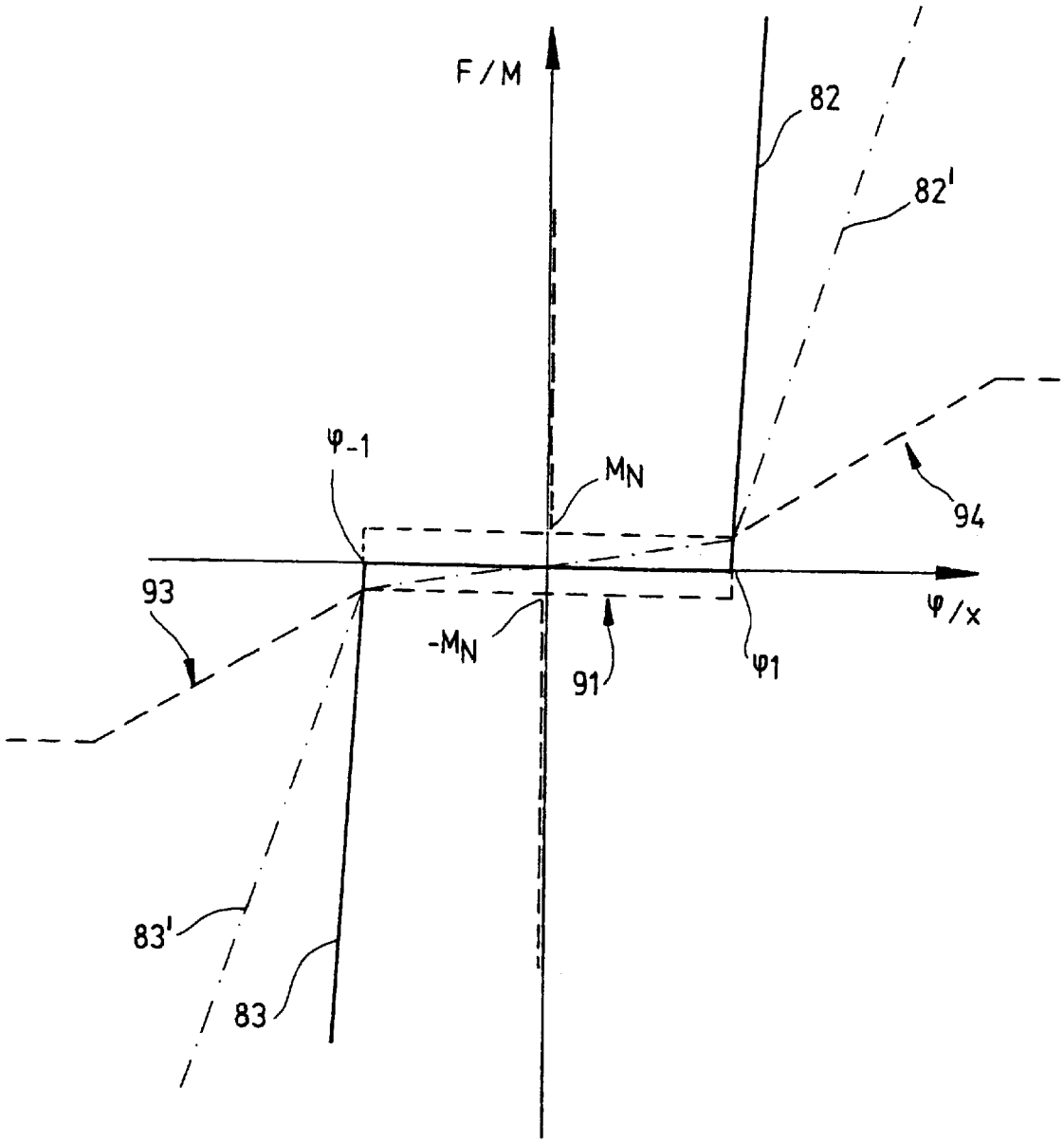
FIG. 5 is a diagram of the characteristic transmission line of the coupling device of FIG. 3 and of permitted ranges for the characteristic curve.

The coupling device 37 is characterized, for example, by the thick solid characteristic curve line in FIG. 5. The characteristic curve is the characteristic torque-angle curve. The angle of rotation $\phi$ is the torsion between the coupling halves 52, 53 or between the shafts 38, 39. For a selected operating range 91, which is arranged symmetrically with respect to the zero point of the diagram, no transmission takes place. The operating range 91 limits all characteristic curve courses, which are possible here, to the transmission of a negligible torque, of a so-called zero torque $M_N$ or $-M_N$. That is, for all angle differences which are smaller than the differential angles of rotation $\phi_1$, $\phi_{-1}$, no torque transmission is possible which is larger than this negligible torque $M_N$, $-M_N$. These zero torque values are so low that the automatic control loops 76, 77, which operate independently of one another, cannot interfere with one another.

If the differential angle of rotation $\phi$ is larger than the value $\phi_1$ or smaller than the value $\phi_{-1}$, a larger coupling torque is transmitted which is so large that the differential angle of rotation $\phi$ can no longer significantly change. The characteristic curve section 82, 83 existing here is significantly steeper than in the range 91 and preferably, is almost parallel to the M axis. The permissible range 93, 94, in which the characteristic curve section 82 can be situated, is bordered by a broken line. The characteristic curve sections 82, 83 may also be slightly flatter than shown. This is illustrated by dash-dotted characteristic curve sections 82, 83. It is important that a torque is transmitted which is sufficient for causing a failed drive to rotate along so that the transfer bars 12, 14 can be opened sufficiently rapidly.

In normal operation of the transfer system, the two automatic control loops 76, 77 adjust the transfer bar position defined by the control system 81 independently of one another. The automatic control loops 76, 77 operate virtually independently of, but synchronously to, one another. As a result, the coupling halves 52, 53 do not engage. As a statistical average, the teeth of the coupling halves 52, 53 are precisely positioned to fill gaps. Occurring control deviations and an overshooting of individual control loops, in the regular operation, is no larger than the play between the coupling halves 52, 53 so that no power transmission takes place by way of the coupling device 37.

If an automatic control loop 76, 77 or a motor 21, 22 fails, however, the corresponding transfer bar 31 would remain in its taken-up position without the coupling device 37. Here, the coupling device 37 immediately moves through the existing play and the coupling halves 52, 53 engage. If, for example, the motor 21 has failed, the motor 22, by way of the coupling device 37, will now also drive the right-side transfer bar 14. If the threaded spindle 24 of the left closing box 17 has, for example, a left-handed thread, and the threaded spindle 24 of the right closing box 18 has, for example, a right-handed thread, this rotation of the threaded spindle 24 in the same direction causes an adjustment of the transfer bars 12, 14 toward one another or away from one another. Thus, a simultaneous driving of both threaded spindles 24 without the aid of the motor 21 allows the motor 22 to move the transfer bars 12, 14 out of the tool range. The automatic control loop 76 compensates the higher loading of the motor 21 by a correspondingly stronger triggering thereof. The motor 22 is dimensioned such that it will withstand this higher load at least for a single operating stroke. As required, the motor 22 may also be dimensioned such that the operation can continue at a reduced speed possibly by using a shaped piece, which can be inserted in the coupling device to eliminate the play, or by using a bridge coupling. Thus, the entire press system can, for example, complete at least one lot, before the failed drive is serviced.

Figure 7:
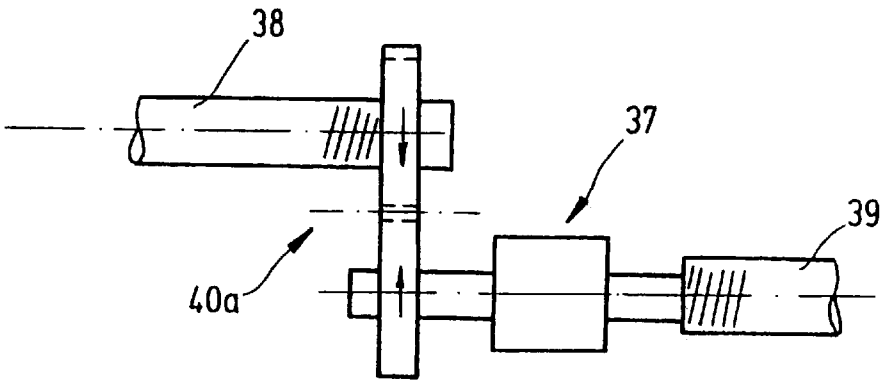
FIG. 7 is a schematic view of a coupling device which, by way of one coupling half, is directly connected to a shaft of a drive and is connected indirectly by way of an intermediate transmission to another shaft of another drive.

Alternatively, both threaded spindles 24 may also have right-handed threads. In order to achieve a movement of the transfer bars 12, 14 in opposite directions, a transmission 40*a* will then be arranged on one side of the coupling device 37. This transmission 40*a* has a ratio of 1:1 and reverses the rotating direction. Such an embodiment is illustrated in FIG. 7.

Figure 6:
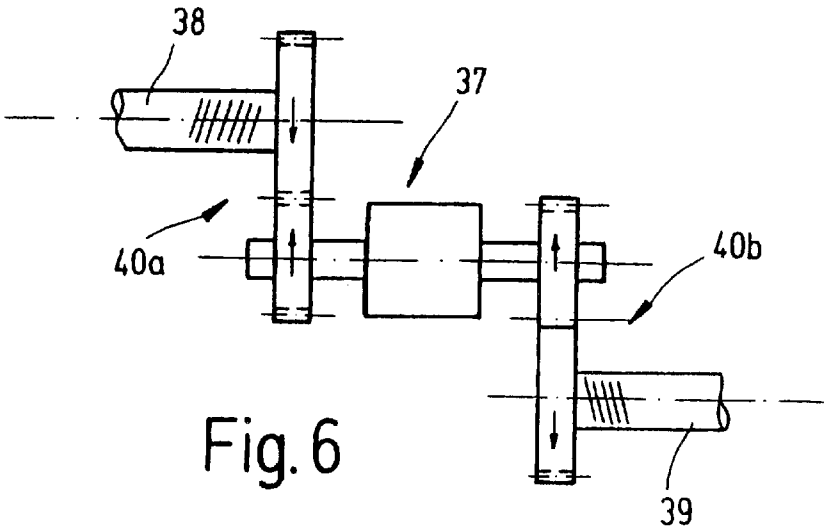
FIG. 6 is a schematic view of a coupling device arranged by way of intermediate transmissions between two shafts of two mutually assigned drives.
Figure 8:
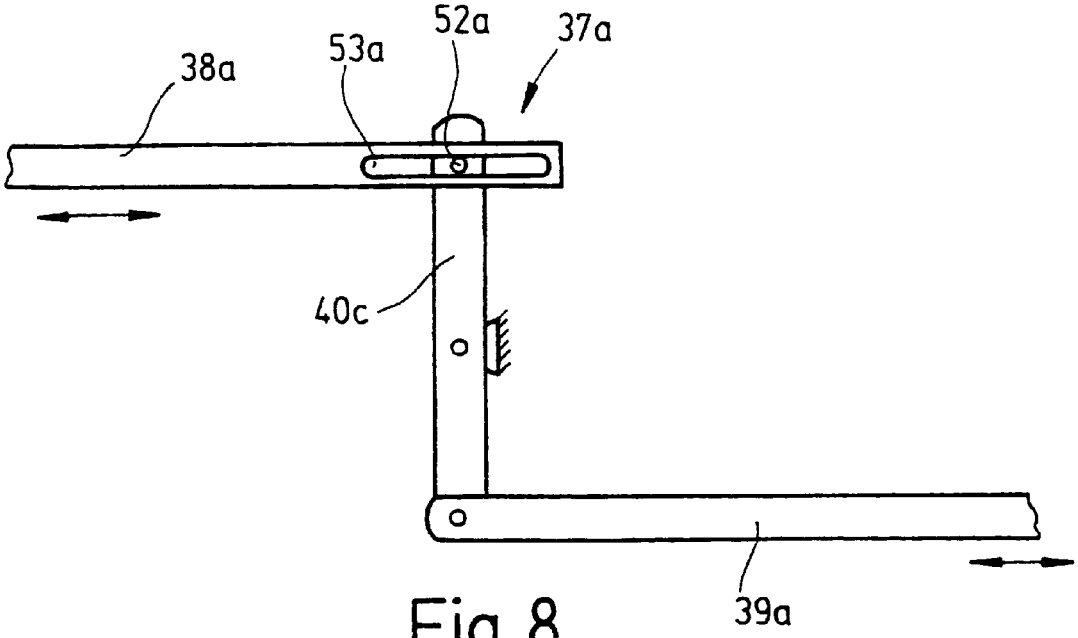
FIG. 8 is a schematic view of a translational coupling device for coupling two oppositely operating drives or devices.

As indicated in FIG. 4, the shafts 38, 39 can be aligned with one another. If, as illustrated in FIGS. 7 and 8, the shafts are offset with respect to one another, the connection between the shafts 38, 39 and the coupling device can take place on one side of the coupling device 37 or on both sides of the coupling device 37 by a transmission 40*a*, 40*b*. As a result, as seen in FIG. 6, shafts 38, 39 can be coupled to rotate in the same direction, or as seen in FIG. 7, shafts 38, 39 can be coupled which rotate in opposite directions.

Figure 9:
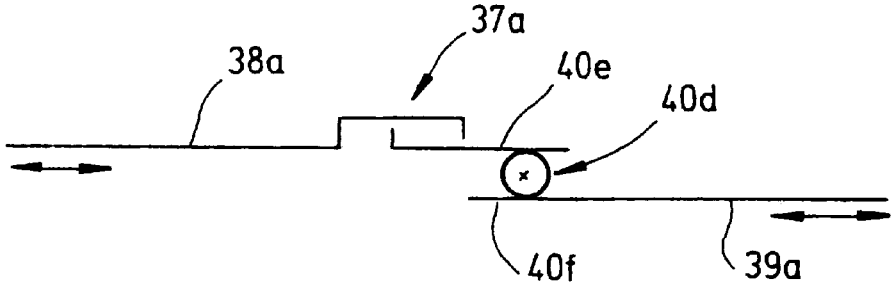
FIG. 9 is a schematic view of another translational coupling device for coupling two oppositely operating drives or devices.

A coupling of two drives can also take place by coupling linear movements to one another. Corresponding embodiments are schematically illustrated in FIGS. 8 and 9. For example, in the embodiment according to FIG. 8, the translational movement of a rod 38*a* is transmitted by a coupling device 37*a* to a lever 40*c* operating as a reversing transmission. The coupling device 37*a* is formed by a driving device, such as a pin 52*a*, provided at an end of the lever disposed to be swivellable approximately in the center, which pin 52*a* is disposed in an oblong opening 53*a* of the rod 38*a*. At its other end, the lever 40*c* is articulatably connected with a rod 39*a* moved in the opposite direction with respect to the rod 38*a*.

In the regular operation, the rods 38*a*, 39*a* are translationally moved synchronously with respect to one another so that the pin 52*a* remains approximately in the center in the oblong recess 53*a* and no power transmission takes place. If the drive of one of the rods 38*a*, 39*a* fails, there is a passing through the play existing in the oblong opening 53*a*, and the driving device or pin 52*a* comes to rest on at least one end of the oblong recess 53*a* for power transmission to take place. If movements in the same direction are to be coupled, the lever 40*c* can be eliminated.

In the embodiment according to FIG. 9, instead of the swivel lever 40*c*, a rotatably disposed gear 40*d* is provided which meshes on diametrically opposite sides with toothed rack sections 40*e*, 40*f*, which are disposed so as to be translationally movable. While the toothed rack section 40*f* is fixedly connected with the rod 39*a*, the coupling device 37*a* is arranged between the toothed rack section 40*e* and the rod 38*a* and can be constructed as illustrated, for example, in FIG. 8.

Figure 5A:
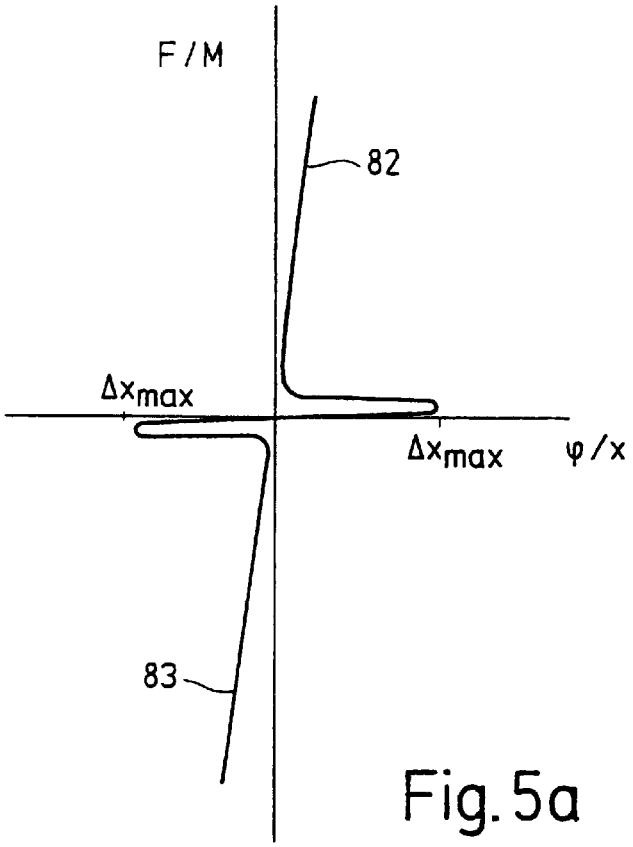
FIGS. 5*a* and 5*b* are diagrams of modified characteristic transmission curves of the coupling device.
Figure 10:
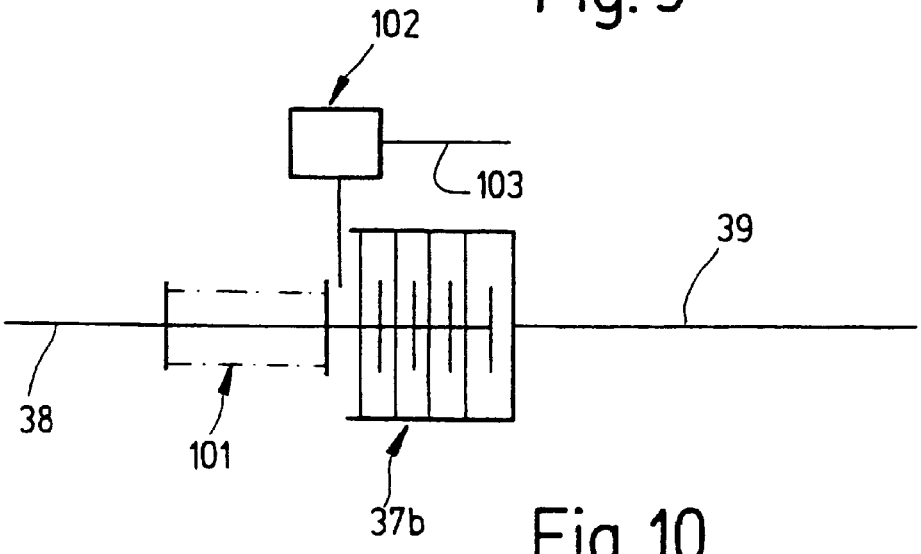
FIG. 10 is a schematic view of an externally controlled coupling device for the non-rotatable coupling of two driving devices in the event of a failure.

The above-described coupling devices 37, 37*a* are characterized by an existing play of movements. They control the engagement and disengagement therefore themselves by way of the existing angular difference or path difference. The coupling device 37 can, however, be externally controlled schematically illustrated in FIG. 10. The coupling device 37*b*, which is used for a possibly required coupling of two shafts 38, 39, is normally in a disengaged condition. A spring device 101 is used for the engagement which is locked in the prestressed condition. The arrangement is releasable, whereby its spring force will then frictionally engage the disks of the multidisk coupling 37*b*, so that the shafts 38, 39 are non-rotatably coupled. For the triggering of the spring device 101, a mechanical control device 102 is used which has a control input 103. The control input may be a mechanical or electric, a pneumatic or hydraulic signal input. In the present example, it reacts to an electric signal which is derived, for example, from the motors 21, 22 or the controllers 76, 77. The characteristic curve of such a coupling device is illustrated in FIG. 5*a*. If a maximal path difference $\Delta x_{max}$ is exceeded in the positive or negative direction, the control device 102 releases the spring device 101, which forms a spring loading device, and the multidisk coupling device 37*b* engages.

As required, the multidisk coupling device 37*b* may be replaced or supplemented by a form-locking coupling device, such as a claw-type coupling device. In this embodiment, the claws can be provided with inclined planes which, during the engagement, cause a certain torsion of the shafts 38, 39 with respect to one another and thus a fixed position thereof with respect to one another. Instead of the spring device, any other energy accumulator or drive can be provided.

Figure 5B:
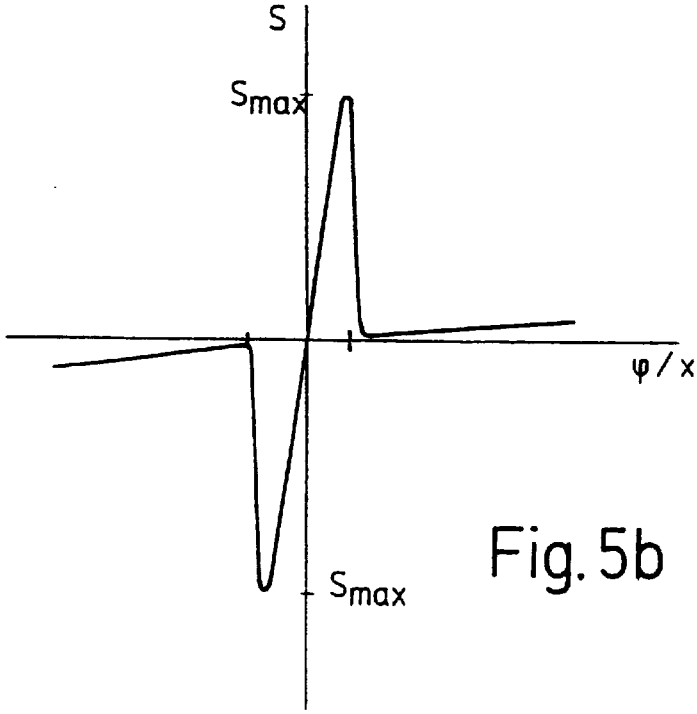

Finally, it is also possible to control the coupling device 37, 37*a*, 37*b* as a function of the differential rotational speed of the shafts 38, 39 or of the differential speed of the rods 38*a*, 39*a*. If a maximal slip $S_{max}$ is exceeded, no further torsion or displacement of the individual coupling halves with respect to one another is permitted. A corresponding characteristic curve is illustrated in FIG. 5*b*.

A transfer system 1 has at least one transfer device 12, 14 which is driven by several mutually independent drives 17, 18 in the direction of at least one axis C, O. In order to prevent, in the event of a failure of a drive 17, 18, an immediate stoppage of parts of the transfer device, the drives 17, 18 are coupled with one another by an externally controlled or self-controlled translational or rotary coupling device 37. This coupling device 37 has an operating range of a low torque transmission which is normally taken up and which is left only if one of the drives 17, 18 no longer supplies a sufficient driving power.

In the same manner, drives of two-axis or three-axis transfer systems are also contemplated by the present invention as well as drives, for example, for feeding and removable devices. That is, the invention is not limited to a certain driving axis of a triple transfer system. The coupling device can therefore be arranged in any transmission line, as illustrated, for example, also in FIGS. 6, 7 or 9.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A transfer system for transfer presses and the like, comprising a transfer device operatively linked with at least one working station, at least two driving devices operatively associated with the transfer device, and a coupling device for connecting the driving devices with one another and having, in a selected relative movement or operating range, a power or torque transmission of lower value than a limit value and otherwise a higher value of power or torque transmission.

2. The transfer system according to claim 1, wherein transfer device comprises two transfer bars equipped with gripper devices and extending along several working stations in a transporting direction, the transfer bars being arranged to be movable toward and away from one another by way of the at least two driving devices.

3. The transfer system according to claim 1, wherein the selected operating range is defined by one of an angle of rotation difference or a path difference between transmission devices which are each assigned to one of the at least two driving devices.

4. The transfer system according to claim 1, wherein the coupling device has a non-linear characteristic angle-torque or path-power curve.

5. The transfer system according to claim 4, wherein the non-linear characteristic curve is a bent characteristic curve.

6. The transfer system according to claim 4, wherein the characteristic curve has linear sections.

7. The transfer system according to claim 6, wherein the non-linear characteristic curve is a bent characteristic curve.

8. The transfer system according to claim 1, wherein the torque or power transmission is zero in the selected operating range.

9. The transfer system according to claim 1, wherein the torque or power transmission outside the selected operating range is free of differential angles and differential paths.

10. The transfer system according to claim 1, wherein at least two driving devices have a maximal driving power reachable at least for a short time and sized to operate multiple components of transfer device at least for a sufficient time period.

11. The transfer system according to claim 1, wherein the at least one working station is a press station.

12. The transfer system according to claim 1, wherein the at least two driving devices include electric drives.

13. The transfer system according to claim 12, wherein the electric drives are rotary drives.

14. The transfer system according to claim 12, wherein the electric drives are linear drives.

15. The transfer system according to claim 1, wherein the coupling device is one of a rotary coupling device and a linear coupling device which, relative to the power transmission direction, has a rotational or linear play.

16. The transfer system according to claim 1, wherein each of the at least two driving devices includes an automatic control system configured to control the respective driving device according to data of a control device.

17. The transfer system according to claim 16, wherein the automatic control system is operatively connected with a position sensing device to detect an actual position of the transfer device, and the automatic control system is arranged to control the drive according to the data of the control device to a desired position.

18. The transfer system according to claim 1, wherein a size of the selected operating range is set such that, during a proper functioning of the driving devices, no limit-value exceeding power exchange takes place by way of the coupling device.

19. The transfer system according to claim 1, wherein a size of the selected operating range is set such that, during a proper functioning of the at least two driving devices, no power or torque transmission takes place by way of the coupling device.

20. The transfer system according to claim 1, wherein the coupling device is an externally controlled coupling device.

* * * * *